United States Patent [19]

Connolly

[11] 4,356,933

[45] Nov. 2, 1982

[54] CYLINDRICAL WOVEN FABRIC TANK

[76] Inventor: James P. Connolly, 26 Waterloo Park, Belfast B15 5HU, Ireland

[21] Appl. No.: 169,170

[22] Filed: Jul. 15, 1980

[30] Foreign Application Priority Data

Sep. 17, 1976 [GB] United Kingdom ..... 38720/76

[51] Int. Cl.[3] ..... B65D 90/20; B65B 67/12

[52] U.S. Cl. ..... 220/401; 220/18.1; 220/404; 4/506; 248/99; 150/1

[58] Field of Search ..... 220/1 B, 18.1, 70.1, 220/401, 410, 461, 404; 150/0.5, 1; 4/488, 506, 507, 513, 584–587; 248/99

[56] References Cited

U.S. PATENT DOCUMENTS

| | | | |
|---|---|---|---|
| 2,378,159 | 6/1945 | Royer | 220/1 B |
| 2,567,514 | 9/1951 | Hoffman | 4/587 |
| 2,633,172 | 3/1953 | Treiber | 150/0.5 |
| 3,085,027 | 4/1963 | Porteous | 150/0.5 |
| 3,085,708 | 4/1963 | Dosker | 220/461 X |
| 3,373,451 | 3/1968 | Schmidt | 4/585 |
| 3,951,284 | 4/1976 | Fell et al. | 220/404 |
| 4,055,201 | 10/1977 | Fowler et al. | 150/1 X |
| 4,143,796 | 3/1979 | Williamson et al. | 150/1 X |
| 4,207,937 | 6/1980 | Sandeman et al. | 150/1 |

FOREIGN PATENT DOCUMENTS

| | | | |
|---|---|---|---|
| 1315875 | 12/1962 | France | 248/99 |

*Primary Examiner*—William Price
*Assistant Examiner*—Gary E. Elkins
*Attorney, Agent, or Firm*—Murray and Whisenhunt

[57] ABSTRACT

A container for fluent material has a limp flexible bottom and an upstanding limp flexible perimetral circular wall. The wall is kept upstanding by flexible support means between the upper edge of the wall and the upper horizontal member of a framework surrounding and spaced from the perimetral wall. The wall is of waterproof-coated woven synthetic fabric with the warp running lengthwise around the wall and the weft upright. The fabric has a strength-to-weight ratio and stretch characteristic sufficient that the wall requires no internal reinforcement or external support against outward pressure from contents when filled into the container.

7 Claims, 12 Drawing Figures

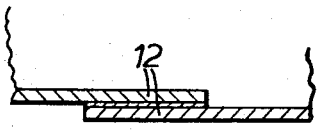
FIG. 4a
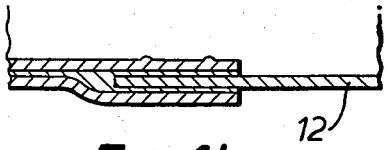
FIG. 4b
FIG. 4c
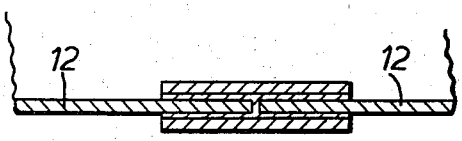
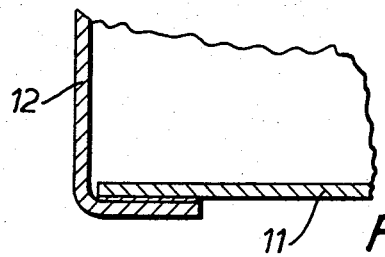
FIG. 5.
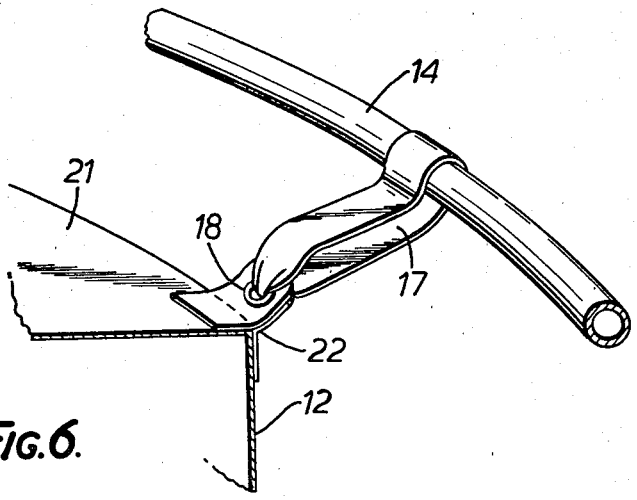
FIG. 6.

CYLINDRICAL WOVEN FABRIC TANK

This invention relates to a static tank or container for holding a fluent material (namely a liquid, a gaseous product or granular material).

The present invention is a static tank or container for holding a fluent material and having a limp flexible bottom for resting on a flat surface and from which upstands a limp flexible perimetral wall maintained upstanding by flexible support means connected between the upper edge thereof and an upper horizontally disposed continuous member of a framework surrounding said perimetral wall and spaced therefrom, at least said wall being formed of a waterproofcoated woven fabric of a synthetic material, the warp of said fabric running lengthwise around said wall and the weft thereof being upright and said synthetic material having a strength-to-weight ratio and a stretch characteristic sufficient that the wall requires no internal reinforcement or external support against outward pressure from contents when filled into the tank or container.

Preferably, said flexible support means comprises a plurality of separate straps or separate helical springs engaging with eyelets in the upper end of said perimetral wall. Alternatively, the straps or springs pass through said eyelets for engagement with one or more retaining members located on the inner peripheral face of said perimetral wall.

Alternatively, said flexible support means comprises a plurality of resilient sheets looped around the upper horizontally disposed unit and secured to the upper end of the wall.

An embodiment of the present invention will now be described, by way of example, with reference to the accompanying drawings, in which.

Figure 1:
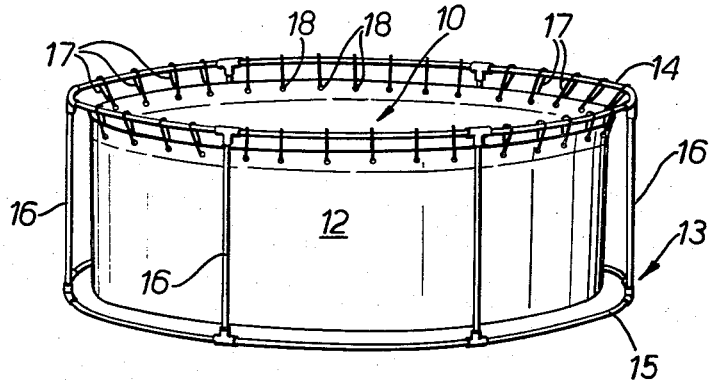
FIG. 1 is a view of a static tank or container according to the present invention.
Figure 2:
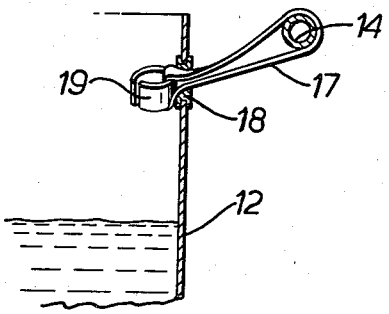
FIG. 2 is a detail.
Figure 3A:
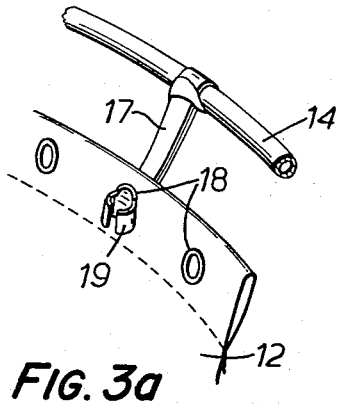
Figure 3B:
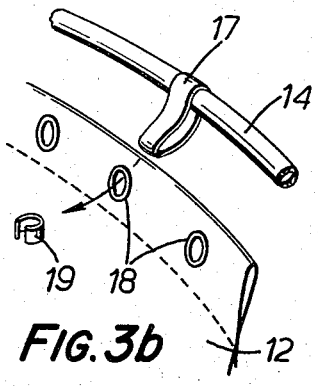
Figure 3C:
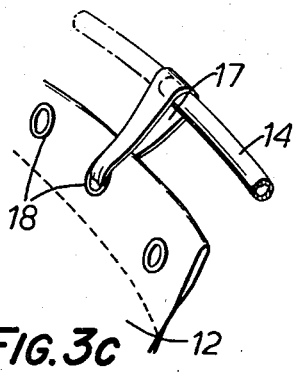
Figure 3D:
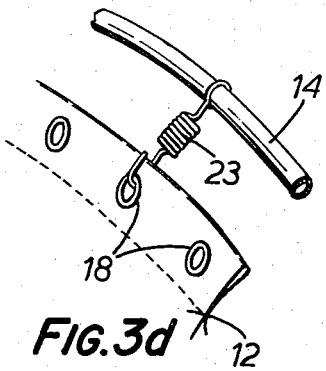
Figure 3E:
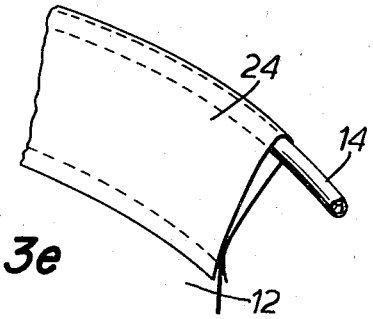

FIGS. 3(*a*), 3(*b*), 3(*c*), 3(*d*) and 3(*e*) show a selection of flexible support means between the static tank or container and a surrounding framework;

FIGS. 4(*a*), 4(*b*), and 4(*c*) show a selection of vertical wall joints;

FIG. 5 shows a floor (bottom) and wall joint; and

FIG. 6 shows a detail of a static tank or container having an integral roof.

Referring to the drawings, a tank or container 10 for holding liquid is provided having a limp flexible bottom 11 to rest on a flat surface and a limp flexible perimetral or peripheral wall 12 which is circular in plan and terminates at its upper or free edge in a rim so that the tank or container 10 is fully open at its upper end. Also provided is a surrounding framework 13 spaced outwardly of the wall 12 and having circular upper and lower horizontal members 14 and 15 spaced apart by a few upstanding rods 16, the members 14 and 15 and rods 16 being of hollow section tube, for example of aluminium or coated mild steel. Bracing members (not shown) may be fitted to either or both sides of some or all of the rods 16 adjacent the top and/or the bottom of the rods to connect to the adjacent horizontal member by suitable means, such as a clevis pin and spring retaining clip. Such bracing members may be constructed so as to pivot into alignment with rods 16 when the tank is collapsed.

The various fittings and fixings may be of any suitable material and thus the fittings to provide the bracing members may be of metal or moulded PVC, while fixings such as screws bolts and rivets may be of stainless steel or cadmium coated mild steel.

The wall 12 of the container is secured to the upper horizontal member 14 of the framework by flexible support means in the form of separate elastic straps 17 which pass round the member 14, through the respective one of a series of eyelets 18 provided in the upper marginal edge of the wall 12. The looped end of each strap 17 is prevented from disengagement with the eyelet 18 by a split plastic retaining ring 19 inserted through the looped end of the strap 17. In this manner, the support means solely supports the upper rim of the wall 12 upwardly of the bottom 11, but provides no support against the outward pressure on the wall 12 from contents of the tank or container 10. Such external support is unnecessary because the base and wall are formed by a waterproof-coated woven fabric of a synthetic material having a strength-to-weight ratio and a stretch characteristic sufficient that the wall 12 requires no internal reinforcement or external support against outward pressure from contents when filled into the tank or container. The fabric may be, for example a P.V.C.—coated synthetic woven fabric or a rubber-coated synthetic woven fabric. Suitable fabrics are known under the trade names NYTARP 12, WINTERBOTTOM PE620 or PE723, BM COATINGS P664 or P683.

The wall 12 is formed of one length of fabric and only a single joint is required, the fabric being arranged with the warp running lengthwise around the tank or container and the weft upright perpendicular to the base.

The bottom 11 may be of a different material than the wall 12 since it is not necessary to have a reinforced material when the bottom 11 is supported on a flat surface, the material being such as flexible vinyl sheet.

Strips of the fabric are commonly welded electronically in a plain lap joint, for example by high frequency plastic welding. However, it is also possible to joint the fabrics using adhesives and to provide different forms of joint; for example, for jointing two pieces of fabric to form part of the wall, the following joints, as shown in FIG. 4 can be used:

(a) Lap joint—in which the marginal edge of one piece overlaps that of another with adhesive therebetween or by joining by welding.

(b) Stitched lap joint with sealing strip—in which the simple lap joint is secured by stitching and covered by an additional strip of material secured thereto by adhesive or welding;

(c) Sandwich joint—in which the marginal edges abut and are covered on each side by a strip secured by adhesive or welding.

For jointing the wall fabric to the bottom or floor fabric, the marginal edge of the former is folded under the latter and secured by adhesive or welding as shown in FIG. 5. Alternatively, the marginal edge of the former is folded over the latter and secured by adhesive or welding.

The frame is preferably cylindrical, but may be polygonal. Ropes, for example of P.V.C. covered galvanised steel wire, may be threaded through the base of each rod 16 to replace the lower horizontal members 15.

FIG. 3 shows five different forms of flexible support means as follows:

(a) an elastic strap 17 looped around the member 14, through its loop and through the respective one of the eyelets 18 with the other looped end of the strap 17 being prevented from disengagement with the eyelet 18 by a clip 19 inserted through the looped end of the strap 17;

(b) an elastic strap 17 passed around the member 14 and through the respective one of the eyelets 18 with the looped end of the strap 17 being prevented from disengagement with the eyelet 18 by a clip 19 inserted through the looped end of the strap 17;

(c) an elastic strap 17 passed round the member 14 and passed through and around the respective one of the eyelets 18;

(d) a helical spring 23 having one end passed around the member 14 and the other end passed through and around the respective one of the eyelets 18, and (e) a resilient sheet 24 looped around the member 14 between the junctions of two adjacent rods 16 with member 14, the opposed sides of the sheet being secured by adhesive or welding to the upper end of the wall 12 which in this case is not provided with eyelets 18.

Of course, other flexible support means can be employed. For example clips, suitably of stainless steel, may be hooked at intervals to holes provided in member 14, the outer end of the clips providing a bar about which passes a strap which also passes through an aperture in the eyelets of the wall 12.

The flexibility of the structure of the tank or container and resilience of the flexible support means supporting the top of the tank or container from the framework allows the forces introduced by the contents load to be distributed uniformly in the fabric and avoid stress concentrations.

The tank or container may be provided with a roof and, to hold a gaseous medium, roof 21 is provided integral with the tank or container 10 as shown in FIG. 6, a series of lugs 22 being provided spaced around the top of the tank or container, each lug 22 being eyeleted for use with one of the forms of the flexible support means to secure the top of the tank to the member 14.

Pipe connections or vents may be provided in the wall 12 or roof 21 of the tank.

The isolation of the main stresses from the framework by the resilient connection means minimal frame requirements.

The tank or container can be used for a variety of purposes and in different surrounds, viz.:

Agriculture: Water, grain or slurry storage, irrigation uses, fish tanks.

Industry: Water storage or fire fighting reservoir, storage of waste or process liquids, storage of gaseous products.

Domestic: Water storage, container for sewage treatment purposes, swimming pools.

The commercial attraction of the tank lies mainly in its-Low cost.

Ease of transport, storage, erection.

Range of sizes and colour.

In addition, the advantages of tank and materials are:

Lightweight, high strength, low stretch.

Non rip or tear.

Rot proof; resistant to most chemicals;

non toxic.

Stable in extreme temperatures.

Available in variety of colours which can be conveniently printed on.

Can be folded into small volume.

Fabrication relatively simple.

Low maintenance, easily patched or repaired.

The tank may be, for example, 4 ft high by 10 ft diameter (approximately 2,000 gallons of water).

I claim:

1. A cylindrical static vessel for holding a fluent material comprising a. a flexible, generally planar vessel bottom;

b. a flexible, perimetral wall upstanding from the vessel bottom and circular in plan, said perimetral wall being formed of waterproof-coated woven fabric of synthetic material, the warp of which runs lengthwise around said wall and the weft thereof being generally upright, said synthetic material having a sufficient strength-to-weight ratio and stretch characteristics sufficient that the wall requires no internal reinforcement or external support against outward pressure from filled vessel contents; and c. framework means for supporting the upper edge of an empty vessel without supplying substantial support to the vessel when the vessel is filled with said fluent material and resting on a stable, level surface, said support means including a framework surrounding said perimetral wall and including an upper, generally horizontally disposed member, and flexible support means connected between said upper horizontally disposed member and the upper edge of the perimetral wall to maintain said perimetral wall in an upstanding position when the vessel is empty.

2. In a cylindrical vessel for holding a fluent material comprising a flexible, generally planar vessel bottom, a flexible vessel perimetral wall upstanding from said bottom and generally circular in plan, and a framework surrounding said perimetral wall and supporting same, the improvement comprising at least said perimetral wall being formed of waterproof coated fabric woven from synthetic material, the warp of said fabric running lengthwise around said wall, and the weft of said fabric being generally vertically upright, said synthetic material having a strength-to-weight ratio and stretch characteristics such that the wall requires no internal reinforcement or external support against the outward pressure of the vessel contents when the vessel is filled, said support framework including an upper, generally horizontally disposed member, and flexible support means connected between the upper edge of said perimetral wall and said upper generally horizontally disposed member, said framework supplying substantially no support to said vessel against the pressure from the filled vessel contents when the vessel is resting on a stable, level surface.

3. Vessel of claim 1 or claim 2, wherein said perimetral wall is a substantially straight, substantially vertical perimetral wall.

4. Vessel of claim 1 or claim 2, wherein said perimetral wall has a single generally vertical seam therein.

5. Vessel of claim 1 or claim 2, wherein said flexible support means comprises a plurality of separate, elastic straps.

6. Vessel of claim 1 or claim 2, wherein said flexible support means comprises a plurality of separate helical springs.

7. Vessel of claim 1 or claim 2, wherein said flexible support means comprises a plurality of resilient sheets looped around the upper horizontally disposed member and secured to the upper end of said perimetral wall.

* * * * *